United States Patent [19]

Sergeev et al.

[11] Patent Number: 4,469,984

[45] Date of Patent: Sep. 4, 1984

[54] GRID-LIKE ELECTRODE FOR ELECTRONIC COMPONENTS AND PROCESS FOR MAKING SAME

[76] Inventors: Jury S. Sergeev, prospekt Morisa Tpreza, 30, kv. 24; Stanislav M. Shatalov, Svetlanovsky prospekt, 109, kv. 291; Vladimir G. Vildgrube, Svetlanovsky prospekt, 44, korpus 2, kv. 144; Iosif L. Gandelsman, Obvodny kanal, 157, kv. 11; Valeria K. Kuznetsova, prospekt Shvernika, 37, kv. 40; Iosif S. Libman, ulitsa Akademika Konstantinova, 10, korpus 1, kv. 155, all of Leningrad; Egor N. Ljukshin, ulitsa Baltiiskaya, 24, korpus 2, kv. 66, Moscow; Vyacheslav I. Frolov, 2 Chernogradskaya ulitsa, 7, korpus 2, kv. 28, Moscow; Valery I. Kostikov, ulitsa Marii Ulyanovoi, 9, korpus 2, kv. 12, Moscow, all of U.S.S.R.

[21] Appl. No.: 348,230

[22] Filed: Feb. 12, 1982

[30] Foreign Application Priority Data

Feb. 13, 1981 [SU] U.S.S.R. ..... 3237651

[51] Int. Cl.[3] ..... H01J 1/46

[52] U.S. Cl. ..... 313/348; 313/350; 313/355; 445/46; 445/49

[58] Field of Search ..... 313/348, 350, 355; 445/46, 49

[56] References Cited

U.S. PATENT DOCUMENTS

| | | | |
|---|---|---|---|
| 2,282,098 | 5/1942 | Taylor | 445/46 X |
| 3,307,063 | 2/1967 | Sarrois | 313/348 |
| 3,971,964 | 7/1976 | Slosiar | 313/348 X |
| 4,034,031 | 7/1977 | Lersmacher et al. | 445/46 X |
| 4,137,477 | 1/1979 | Krol et al. | 313/348 |

FOREIGN PATENT DOCUMENTS

| | | | |
|---|---|---|---|
| 881797 | 11/1961 | United Kingdom | 445/46 |

*Primary Examiner*—Eugene R. LaRoche
*Assistant Examiner*—Vincent De Luca
*Attorney, Agent, or Firm*—Burgess, Ryan & Wayne

[57] ABSTRACT

A grid-like electrode for electronic components having its grid portion made of fibrous carbon threads bonded by means of the coke of an organic polymer. The grid-like electrode is made by impregnation of each fibrous carbon thread with a liquid organic polymer containing at least 20% by weight of carbon. Then a grid-like electrode is shaped from these threads and subjected to heating until the polymer is irreversibly cured, followed by heating of the polymer to cause pyrolysis thereof to a glossy carbon state.

14 Claims, 3 Drawing Figures

GRID-LIKE ELECTRODE FOR ELECTRONIC COMPONENTS AND PROCESS FOR MAKING SAME

BACKGROUND OF THE INVENTION

The present invention relates to structural components of electric vacuum devices and, more specifically, to a grid-like electrode for high-power generator devices.

The present invention can be useful as a grid-like electrode any electric vacuum device such as a grid, cathode or heater; in the case of making a cathode according to the present invention, the grid-like electrode is coated with an active emissive layer.

The present invention can be used in the chemical engineering and other industries requiring high-temperature, corrosion-resistant and other electrodes in the equipment produced.

The modern development of the art of high-power generator devices is based on the principle of increasing the output power of instruments and providing higher specific loads on the main operating members of the instruments, particularly on grids.

In well-known structures of grid-like electrodes made with the use of refractory materials such as tungsten, molybdenum and the like, in combination with various coatings, the opportunities for increasing specific loads have been substantially exhausted.

The increasing power of generator devices results in elevation of working temperatures of grids, thus causing lowered antiemission properties, recrystallization of the metal, reduced shape-stability and, consequently, high levels of thermal currents, lowered electrical and mechanical strength of the electronic instrument and breakdown thereof.

With a further increase in power, widening of the range of frequences, improvement of power characteristics and service life of instruments can be ensured only through the manufacture of grid-like electrodes from novel structural materials capable of dissipating high powers, possessing high heat-resistance and stability in operation.

Known in the art are grid-like electrodes made of pyrolytic graphite and shaped as a hollow cylinder with perforations in the form of a grid (cf. U.S. Pat. No. 3,307,063).

Pyrolytic graphite is produced by deposition thereof from a thermally decomposable gas phase.

Having fixed the process parameters (pressure and temperature), it is possible to ensure a high preferable crystalline orientation in the deposited carbon. Properties of the thus-produced layer are close to those of a graphite single crystal.

The process for the manufacture of the prior art grid-like electrode comprises shaping of a hollow cylinder in the manner specified hereinabove, removal of the superficial layer of the material to ensure the required wall thickness by, e.g. grinding, milling or ultrasonic treatment, making cells and partitions by way of abrasion, electronic-beam, electro-erosion or laser cutting.

However, this grid-like electrode and the process for making same fail to provide a satisfactory electrical strength and, besides, demand an expensive and laborious procedure of manufacture.

Furthermore, the need in a grid-like electrode featuring small dimensions of partitions and cells with a considerable length of the electrode faces difficulties associated with the provision of a high mechanical strength and rigidity of the structure.

In the maufacture of a grid-like structure by means of cutting, the cut surface can undergo exfoliation and peeling due to the laminated structure thereof, thus causing reduction in the mechanical and electrical strength of the devices. Furthermore, from pyrolytic graphite it is impossible to make a sophisticated shape of the electrode with small curvature radii, thus necessitating higher dimensions of the grid and the device on the whole.

Known in the art is a grid-like electrode for generator tubes, wherein at least a portion of the electrode directly forming the grid is manufactured from a glassy carbon. The electrode is manufactured by laser cutting the grid-like structure from a blank made of glass-carbon (cf. U.S. Pat. No. 4,137,477).

A disadvantage of this electrode structure and the process for making same resides in a low mechanical strength of the final article. It is very difficult to obtain strict dimensions of grids due to strinkage of the material during the process of manufacture. Another essential disadvantage of the prior art electrode is a high hardness of the glassy carbon close to that of corundum or diamond which substantially hinders its machining by a conventional method.

Known in the art are grid-like electrodes made of carbon fibrous threads coated by pyrolytic graphite which are soldered by means of a solder at the points of their intersection with each other and with supporting members (cf. U.S. Pat. No. 3,971,964).

The process for the manufacture of this electrode comprises coating of pieces of carbon fibrous threads with pyrographite; the resulting rigid rods are secured to the supporting members and fixed to each other at the points of intersection by soldering with a solder to form a grid-like structure.

The above-described grid-like electrodes do not provide a sufficiently high dissipation power, permissible working temperature, electrical strength and stability of characteristics.

These disadvantages stem from the necessity of using solders limiting the permissible working grid temperature, as well as the difficulty of manufacture of the required size accuracy. Furthermore, the prior art process is labour-consuming due to difficulties of shaping of the grid-like structure from rods having a high ridigity. Moreover, the prior art process necessitates high temperatures, increased power consumption and sophisticated process equipment.

The present invention is directed to the provision of such a grid-like electrode, as well as a process for producing this electrode which would have such a material and structure that would enable a higher dissipation power and elevated permissible working temperature of the electrode.

It is therefore an object of the present invention to increase the dissipation power of a grid-like electrode.

It is another object of the present invention to increase the permissible working temperature of a grid-like electrode.

It is still another object of the present invention to improve the mechanical strength of a grid-like electrode.

It is a further object of the present invention to increase the radiation factor of a grid-like electrode.

It is also an object of the present invention to increase electric strength and shape-stability of a grid-like electrode.

Still another object of the present invention is to provide a simple and relatively inexpensive process for the manufacture of a grid-like electrode which would make it possible to reduce the duration of its manufacture, lower labour and power-consumption for its manufacture and enable automation of the procedure of making of the grid-like-electrode.

SUMMARY OF THE INVENTION

The present invention comprises a grid-like electrode for electronic components, said electrode having a grid portion comprising a plurality of elongated grid elements, each of said grid elements comprising a plurality of carbon fibers forming a fibrous carbon thread; and a carbonaceous material bonding said carbon fibers together, at least partially covering said fibers, and filling voids between said fibers, said carbonaceous material comprising the coke of an organic polymer.

This arrangement of a grid-like electrode imparts thereto a high shape-stability, mechanical strength at an elevated permissible working temperature, increased heat-resistance and a high radiation factor.

OTHER FEATURES OF EMBODIMENTS OF THE INVENTION

It is advisable that the amount of the bonding coke of an organic polymer in threads be equal to 10–50%.

This makes it possible to produce a grid-like electrode with different configuration of cells, while retaining geometric parameters of cells over the entire area of the electrode during its operation.

In certain cases it is desirable that the coke of an organic polymer contain 5 to 30% by weight of a refractory electroconducting material.

It is desirable that threads forming the grid portion of the electrode should be fixed to at least one supporting member along the periphery thereof with carbon threads having fibres bonded together by means of coke of an organic polymer.

This enables a good mechanical and electrical contact between the grid-like electrode and the supporting member.

It is possible that threads forming the grid portion should be fixed to at least one supporting member made of a fabric having carbon threads thereof and fibres forming the same bonded by means of coke of an organic polymer.

This makes it possible to use, as the material for the supporting member, materials with different coefficients of thermal expansion and ensures a low value of thermal resistance at the point of contact of the supporting member with the grid-like electrode.

It is advisable that threads of at least its grid portion be coated on all sides with a layer of coke of an organic polymer bonding them together.

This makes it possible to increases the mechanical strength and rigidity of the structure when in operation.

It is desirable that the threads should be covered with a layer of coke of an organic polymer containing a refractory electroconducting material.

This makes it possible to reduce the level of thermal current from the grid-like electrode.

It is desirable that pores and cracks in threads having fibres bonded therebetween with coke of an organic polymer should be filled with pyrocarbon to a mean density of the thread material of from 1.7 to 2.0 g/cm$^3$.

This results in an increase in mechanical strength, electrical and thermal conductivity of the grid-like electrode and reduce gas evolution therefrom.

It is advisable to use, as the coke of an organic polymer, glassy carbon.

This enables a good mechanical and electrical contact between threads forming the grid-like electrode and a higher mechanical strength of the latter in operation at elevated working temperatures.

In some cases, it is desirable that threads of the grid-like electrode be coated on all sides with a layer of pyrographite.

This enables further improvement of the mechanical strength, thermal and electrical conductivity.

The process for the manufacture of a grid-like electrode from fibrous carbon threads according to the present invention resides in that each fibrous carbon thread is passed through a liquid organic polymer with a content of carbon of at least 20% by weight capable of being carbonized after a preliminary irreversible curing so that it is impregnated with this polymer, whereafter a grid-like electrode is formed from these threads on a mandrel and subjected to heating to ensure an irreversible curing of the thread-impregnating polymer, followed by heating the grid-like electrode to pyrolysis of the polymer.

This enables a simplified procedure of the manufacture of the grid-like electrode and reduction of power- and labour-consumption for the production thereof, reduced duration of the manufacturing process, thus producing an electrode possessing improved performances such as high dissipation power, increased shape-stability and mechanical strength at high temperatures.

In shaping of the grid-like electrode it is desirable that the intersecting threads of the grid portion are secured to one another by knitting techniques.

This enables automation of the process of the manufacture of the grid-like electrode.

As the organic polymer for impregnation of threads, it is preferable to use a polymer selected from the group consisting of phenolic, furan, furfuryl, acrylic resins, vinyl series resins, as well as petroleum and coal-tar resins and pitches.

It is most preferable to use, as the liquid organic polymer for impregnation of threads, a solution of phenol-formaldehyde resin in ethanol.

This makes it possible to keep constant geometrical dimensions of the grid during shaping thereof on a mandrel and ensures the desired advantageous properties of the electrode.

It is necessary, in the case of using a thermoplastic polymer as the organic polymer for impregnation of threads, that this polymer is converted into the thermosetting state after shaping of the grid-like electrode.

This enables retained geometrical dimensions and shape of the grid-like electrode during pyrolysis.

After impregnation of threads with a liquid organic polymer, it is advisable to pass the thread through a calibrating orifice to impart a required cross-section shape thereto.

This ensures a uniform cross-section of partitions over the entire area of the grid-like electrode.

After the irreversible curing of the liquid organic polymer, it is desirable that the grid-like electrode is separated from the mandrel.

This provides accuracy of the dimensions and shape of the electrode.

In certain cases prior to the shaping of the grid-like electrode, it is desirable to place onto the mandrel at least one supporting member and, after shaping of the grid portion of the electrode, to fix it to the supporting member by winding, over the grid portion, a fibrous carbon thread impregnated with the above-mentioned liquid orgainc polymer.

This ensures a good mechanical and electrical contact between the grid electrode and the supporting member.

In some cases, it is desirable that each carbon fibrous thread be passed through a liquid organic polymer containing a finely-divided refractory electroconducting material.

This makes it possible to increase the yield of coke residue in pyrolysis of the organic polymer and to improve mechanical strength characteristics of the coke.

In some cases after the irreversible curing of the organic polymer, it is possible to coat threads of at least the grid portion of the electrode with a layer of a liquid organic polymer with a content of carbon of not less than 20% by weight which is capable of being carbonized after a preliminary irreversible curing and to subject the electrode to heating to ensure an irreversible curing of the polymer in the above-mentioned layer.

This ensures an enhanced mechanical strength of the resulting grid-like electrode.

The present invention is further illustrated by the following detailed description of its particular embodiment with reference to the accompanying drawings, wherein:

DETAILED DESCRIPTION

Figure 1:
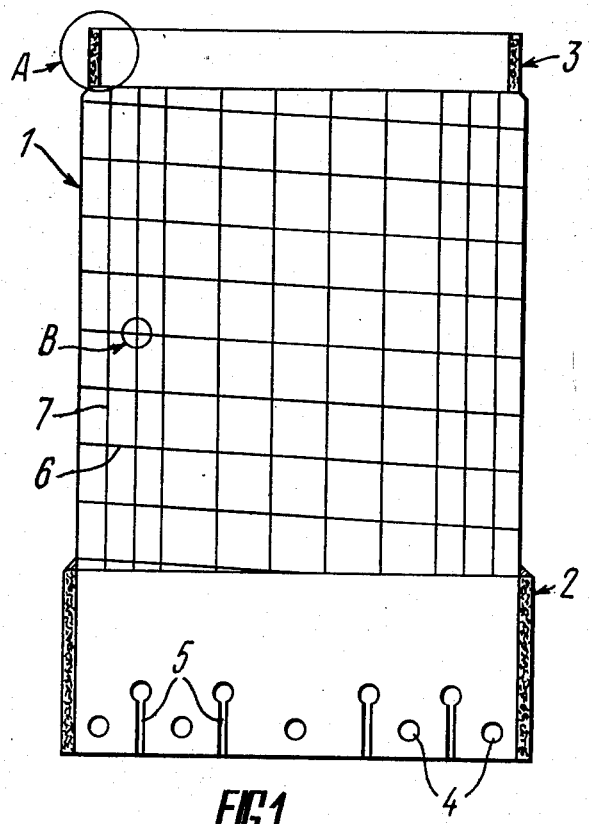
FIG. 1 is a schematic view of a grid-like electrode according to the present invention.

The grid-like electrode according to the present invention comprises a grid portion 1 per se (FIG. 1) and one or more supporting members 2, 3 whereto the grid portion 1 is fixed. The supporting members 2 and 3 serve to support the grid portion 1, impart rigidity, mechanical strength to the structure, as well as to ensure a mechanical, thermal and electrical contact of the grid electrode in an electric vacuum device by means of openings 4 and slits 5. The grid portion 1 of the electrode is made of interlacing fibrous carbon threads 6 and 7 having their fibres bonded by means of coke forming in pyrolysis of the organic polymer employed for impregnation of each carbon thread.

The coke comprises a solid residue formed in pyrolysis of various organic polymers in a neutral, reducing atmosphere or in vacuum.

The content of carbon in the coke is above 96% and depends on the final temperature of pyrolysis, as well as on the nature of the starting organic polymer.

Structural modifications of carbon in the coke, also depending on the starting materials and pyrolysis conditions, can be of various types.

For example, one of the possible forms can be glassy modification of carbon.

As the starting polymers, use is made of organic polymers with a content of carbon of not less than 20% by weight which are capable of being carbonized after a preliminary irreversible curing.

In the case of using organic polymers with a content of carbon below 20%, a coke residue is formed after their pyrolysis which has a low percentage of carbon, unsatisfactory mechanical strength and a high porosity. The most suitable materials for the manufacture of a grid-like electrode according to the present invention are organic polymers selected from the groups consisting of phenolic resins, furan resins, furfuryl resins, acrylic resins, vinyl, polyamide resins, as well as petroleum and coal-tar resins, pitches and derivatives thereof.

To produce a grid-like electrode, the organic polymer prior to pyrolysis should be subjected to an irreversible curing. The irreversible curing is a chemical process of polycondensation which results in the formation of a three-dimensional network of cross-linking bonds in the polymer. As a result, the polymer loses its ability of dissolution and melting. To this end, thermosetting polymers are heated to a temperature within the range of from 100° to 200° C. and thermoplastic polymers are subjected to oxidation in ozone, air, halogens or derivatives thereof or subjected to some other treatment to convert them to the thermosetting ting state.

As a result of a further heat-treatment of a grid-like electrode produced from carbon threads impregnated with an organic polymer, there occurs pyrolysis of the polymer with the formation of a coke bonding fibers of the carbon threads to each other.

Pyrolysis comprises a process of thermal decomposition of an organic polymer accompanied by evolution of volatile matter and formation of a solid carbon residue in the form of coke possessing a high mechanical strength. This results in the formation of a composite material, wherein carbon fibers constitute a reinforcing member, while the coke residue is matrix. The composite material which combines the whole range of physico-chemical properties inherent in its components also has a number of properties substantially superior over those of its components. These properties are obtained due to a physico-chemical compatibility of the components incorporated in the composite material, including a good adherence between the components due to adhesion forces.

The amount of the bonding coke ranges from 10 to 50% by weight of the total of the components. The content of coke in a thread of below 10% does not ensure the required rigidity and shape-stability, whereas at its content of above 50%, mechanical strength of the electrode is decreased.

To improve mechanical strength and electrical conductivity, the coke can incorporate 5 to 30% by weight of a refractory electroconducting finely-divided material.

As the finely-divided refractory material, it is preferable to use carbon black, as well as powder of carbides of refractory metals (WC, MoC, ZrC, TaC and the like), finely-divided graphite, as well as certain refractory metals (Re, W, Mo, Zr and the like).

Properly selected particle size makes it possible to produce the electrode surface with a given value of roughness and, accordingly, an increased radiation factor.

Optimal characteristics are inherent in electrodes with a particle size of the refractory electroconducting material in the coke ranging from 1 to 10 μm.

The introduction of the particles enables a higher, by 15–20 %, electrical conductivity, as well as mechanical strength, since these particles acting as an "extender" prevent the formation of cracks and lower the inner stresses originating in the system under consideration during pyrolysis and use of the final article.

Figure 2:
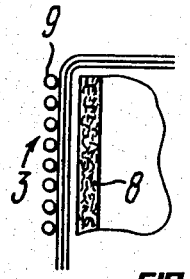
FIG. 2 is a schematic view of region A in FIG. 1 showing the junction of the grid portion with a supporting member.

To ensure a reliable junction between the grid portion 1 of the electrode with supporting members 2 and 3, it is preferred that the latter supporting members 2 and 3 be made of a carbonaceous fabric 8 (FIG. 2) and the grid portion 1 be secured to the supporting members 2 and 3 by winding-on with carbon threads 9. In general, supporting members 2 and 3 (FIG. 1) can be made of different structural materials including graphite, pyrolytic graphite, as well as different metals. Supporting members 2 and 3 made from refractory metals have a desirable in that they are incompatible with the grid portion 1 of a carbon fibre as regards their expansion coefficients. Furthermore, at elevated temperatures, the formation of carbides of refractory metals is possible due to their interaction with carbon threads and coke, thus resulting in a reduced mechanical strength of the electrode.

Supporting members 2 and 3 made of graphite have an insufficient mechanical strength, while those made of pyrolytic graphite feature a high labour consumption. Besides, carbon fibres in a thread 9 (FIG. 2) and fabric 8, as well as threads 9 per se are also fixed to one another by means of coke. The use of supporting members 2 and 3 (FIG. 1) made of a fabric and the above-mentioned mode of their junction with the grid portion of the electrode according to the present invention, allows for elevated working temperatures and thermal cycles owing to compatibility of all components of the electrode as regards their thermal expansion coefficient values.

Figure 3:
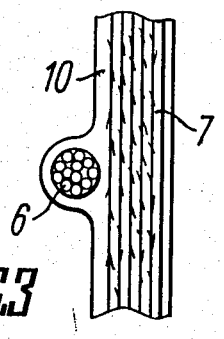
FIG. 3 is a schematic view of region B in FIG. 1 showing intersection of threads of the grid portion in elevation.

To increase mechanical strength of the electrode, threads 6 and 7 (FIG. 3) of its grid portion 1 or the entire electrode should be preferably coated with a layer 10 of coke of an organic polymer. Coke in the coating can be formed by pyrolysis of the same polymer as that employed in impregnation of threads, or of a polymer of a different type as well.

This layer 10 enhances mechanical strength of the electrode and reliability of bonding of threads 6, 7 with one another at the points of intersection of the grid portion 1 (FIG. 1); it also improves fixation of the grid portion 1 to supporting members 2 and 3. The thickness of layer 10 (FIGS. 2 and 3) should not be too great, since this can cause an undesirable decrease of the electrode permeability. To achieve a positive effect, the preferable thickness should be within the range of from 10 to 50 μm. The above-mentioned layer 10 can also contain a refractory electroconducting material in an amount of from 5 to 30%. The role of the refractory material in the layer 10 is just the same as that of the coke bonding fibres in a thread.

For a further improvement of mechanical strength, shape-stability and electrical conductivity, it is preferred to fill all pores, cracks and other defects with pyrolytic carbon forming upon decomposition of carbon-containing gases (such as methane) at a temperature within the range of from 800° to 1,200° C.

This filling of pores and voids should be preferably carried out to ensure a mean density of the thread material of from 1.7 to 2.0 g/cm$^3$. Filling of defects with pyrocarbon to a density below 1.7 g/cm$^3$ is undesirable, since the effect of elevation of mechanical strength and shape-stability is very small, while above 2.0 g/cm$^3$ it is undesirable due to an increasing process duration.

Increase in mechanical strength, shape-stability and electrical conductivity can be attained by way of application, onto the surface of threads of the grid portion 1 and supporting members 2 and 3, of a layer of pyrographite forming upon decomposition of a carbon-containing gas at a temperature within the range of from 1,600° to 2,200° C.

The layer of pyrographite should be made to a thickness ranging from 10 to 50 μm, since this range ensures a positive effect and does not substantially lower "permeability" of the electrode.

To produce a grid electrode according to the present invention, a carbon fibrous thread is passed through a bath a liquid organic material which forms a thermoset polymer on heating in such manner that it would be impregnated therewith.

As the starting organic materials use can be made of various organic thermoset polymer forming materials containing at least 20% of carbon and capable of forming a coke residue on pyrolysis effected after an irreversible curing, i.e. in the thermosetting condition. As such polymeric materials, use is made of organic polymers selected from the group consisting of phenolic, furan, furfuryl, acrylic, vinyl, polyamide, petroleum and coal-tar resins, pitches and derivatives thereof.

It should be noted that the preferred polymers out of materials are phenolformaldehyde resins and various pitches resulting in a yield of coke residue in an amount exceeding 50% by weight.

In practicing the present invention, it is preferred to use phenolformaldehyde resins owing to their thermosetting properties.

In the case of use of pitches owing to their thermoplasticity, the operation of oxidation should be performed to convert them into the thermosetting state which, adds to increased labour use in the process.

To ensure a satisfactory impregnation of a carbon thread, the liquid thermoset polymer forming material should have a predetermined viscosity which depends on the type of polymeric material and carbon thread.

Thus, when a phenolformaldehyde resin is used as a polymer, the resin should be preferably brought to a viscosity ranging from 150 to 200 cPs by dissolution in ethanol.

After impregnation, the thread is passed through a calibrating orifice (such as a spinneret) to impart a predetermined shape and a smooth surface thereto without any roughness and protrusions and a grid electrode is then shaped on a mandrel (not shown). The mandrel corresponds, as regards its configuration and dimensions, to the grid electrode and has grooves on its side surface for placing threads.

Upon shaping of a grid electrode, first secured to the mandrel are preliminarily prepared supporting members 2 and 3 and the grid structure is formed by winding threads onto the mandrel so that its ends are placed above the supporting members 2 and 3. Thereafter the grid portion 1 is secured, by means of a carbon thread 9 impregnated with an organic polymer, to supporting members 2 and 3 by winding the thread onto supporting members 2 and 3 together with the grid portion 1.

To ensure reliable bonding of the interlacing threads 6 and 7 with one another, they can be knitted at the points of intersection by knitting techniques.

The knitting process is preferable in some cases, since it, like winding, enables automation of the process of electrode shaping and high productivity, while retaining the predetermined geometrical dimensions of the grid electrode including dimensons of cells.

Then, the mandrel with the electrode is heated in a furnace at a temperature of from 100° to 200° C. to cure the organic polymeric material.

When a thermoplastic polymer is used as the organic polymer, after shaping of the electrode, the latter should be converted to the thermosetting state, e.g. by oxidation. Thus, upon impregnation of a thread with a solution of pitch in benzene, the shaped electrode on the mandrel is subjected to oxidation in an atmosphere of ozone at a temperature within the range of from 50° to 80° C. or in the air at a temperature of from 100° to 260° C. to a full curing thereof. Then the electrode is removed from the mandrel and subjected to pyrolysis by heating in a neutral, reducing medium or in vacuum to a temperature of at least 800° C.

To improve the mechanical, and electric characteristics of the electrode, the composition of coke bonded carbon fibres in a thread should preferably contain a refractory finely-divided electroconducting material. To this end, the thread is impregnated with a liquid organic polymer which contains finely-divided powder of a refractory electroconducting material uniformly distributed within the bulk of the polymer in suspended condition. The amount of the powder is selected so as to ensure, in the coke, its content of from 5 to 30% by weight after pyrolysis.

For a further improvement of electric and mechanical characteristics, the electrode is coated with a layer of coke containing the refractory finely-divided electroconducting material or free of it.

To this end, after curing of the polymeric material and separation thereof from the mandrel, a layer of a polymeric material having the same or different composition with or without a refractory electroconducting material is applied to the electrode.

The application of this layer can be effected by any conventional method. The most suitable procedure is spraying or dipping. To ensure most accurate thickness and uniformity, the solution employed for dipping or spraying should have a low viscosity. For example, in the case of a phenol-formaldehyde resin, its solution in ethanol should have a viscosity of about 2 cPs. After application of the polymeric layer, it is subjected to an irreversible curing and then pyrolysis is carried out.

The grid-like electrode manufactured according to the present invention has certain advantages over the prior art electrodes such as: a high radiation factor enabling a high power dissipation at a given temperature;

high heat-resistance enabling its operation at elevated working temperatures;

high mechanical strength increasing with elevation of working temperatures;

high resistance against electron and ion bombardment;

high electric strength.

The present invention makes it possible to produce, different components of an electronic instrument including control and screen grids, a base of a cathode electrode and different types of heaters.

These components have improved operating parameters, first of all a high heat-resistance, mechanical strength and resistance to electron and ion fluxes.

The process for the manufacture of the grid-like electrode requires no high power or capital expenses; it is readily susceptible to automation and ensures a high productivity.

The use of the grid-like electrode makes it possible to produce relatively inexpensive electronic instruments having high power output, a wide range of frequencies, increased electrical and mechanical strength, a long service life and high reliability.

What is claimed is:

1. A grid-like electrode for electronic components, said electrode having a grid portion comprising a plurality of elongated grid elements, each of said grid elements comprising:

a plurality of carbon fibers forming a fibrous carbon thread; and a carbonaceous material bonding said carbon fibers together, at least partially covering said fibers, and filling voids between said fibers, said carbonaceous material comprising the coke of an organic polymer.

2. A grid-like electrode as set forth in claim 1, in which said coke of an organic polymer is within the range of from 10 to 50% by weight of said carbonaceous material.

3. A grid-like electrode as set forth in claim 1, in which a dispersed refractory conductive material is distributed in said coke of an organic polymer, said refractory conductive material being within the range of from 5 to 30% by weight of said coke of an organic polymer.

4. A grid-like electrode as set forth in claim 1, further comprising at least one supporting member, said grid portion being secured to said supporting member at the periphery thereof with the aid of a securing means; said securing comprising an additional fibrous carbon thread having fibers secured to one another and to the threads forming said grid portion by the coke of an organic polymer at least partially covering said fibers and filling the voids therebetween in said additional carbon thread; said additional carbon thread engaging a region of said grid portion adjacent said supporting member.

5. A grid-like electrode as set forth in claim 1, further comprising at least one supporting member shaped from a carbonaceous fabric formed from fibrous carbon threads; the fibers of said threads being secured to one another by the coke of an organic polymer at least partially covering said fibers and filling voids therebetween and voids between said threads in said carbon fabric.

6. A grid-like electrode as set forth in claim 1 wherein each of said grid elements further comprises a second layer of the coke of an organic polymer surrounding said carbon threads on all sides thereof; said grid elements criss-crossing one another and said second layer of coke of an organic polymer securing said grid elements to one another at the points of intersection thereof.

7. A grid-like electrode as set forth in claim 6, further comprising a dispersed refractory conductive material distributed in said second layer of the coke of an organic polymer; said refractory conductive material being within the range of from 5 to 30% by weight of said second layer of the coke of an organic polymer.

8. A grid-like electrode as set forth in claim 1, wherein said carbonaceous material comprises pyrocarbon; pores and cracks in said coke of an organic polymer securing said fibers of said carbon threads being filled with said pyrocarbon to mean density of said carbonaceous material of 1.7–2.0 grams per cubic centimeter.

9. A grid-like electrode for electronic components having a grid portion comprising a carbonaceous material comprising a glassy carbon; said grid portion being formed by fibrous carbon threads; the fibers comprising said carbon threads being secured to one another by said glassy carbon, said glassy-carbon at least partially covering said fibers and filling voids therebetween in said carbon threads.

10. A method of manufacturing a grid-like electrode for electronic components, comprising the steps of:

shaping a grid portion by winding on a mandrel an elongated material comprising a liquid organic polymer in which the amount of carbon is not less than 20% by weight, of said material having been prepared by: passing fibrous carbon threads through said liquid organic polymer in such a fashion so as to impregnate the whole of each said thread, to coat the fibers of said thread with said organic polymer and to fill the voids between said fibers; following said impregnation, passing each thread through a calibrated orifice to impart to it a required profile;

after said winding step, heating the material obtained to irreversibly solidify said organic polymer impregnating said fibrous carbon threads; and thereafter heating the shaped grid-like electrode to a temperature sufficient to cause pyrolysis of said polymer and formation of carbonaceous material in which said fibrous carbon threads are embedded in the coke of said organic polymer to secure the fibers of said threads to one another.

11. A method as set forth in claim 10, comprising the additional steps of separating the grid-like electrode from said mandrel after said pyrolysis.

12. A method as set forth in claim 10, including the step of disposing at least one supporting member adjacent said mandrel; after said winding of the grid portion, securing the grid portion to said supporting member over the periphery thereof by winding onto said grid portion in a zone adjacent said supporting member an additional fibrous carbon thread preimpregnated with said liquid organic polymer.

13. A method as set forth in claim 10, including impregnating said fibrous carbon threads by passing the same through a liquid organic polymer having finely-divided refractory conductive material dispersed therein; said conductive material having a concentration such that after said pyrolysis said conductive material is within the range of from 5 to 30% by weight in said coke of an organic polymer.

14. A method as set forth in claim 10, including, after said irreversible solidification of said organic polymer applying a second layer of said liquid organic polymer all sides of said grid portion; and heating said second layer of organic polymer to cause irreversible solidification thereof.

* * * * *